US006279360B1

(12) United States Patent
Shen

(10) Patent No.: US 6,279,360 B1
(45) Date of Patent: Aug. 28, 2001

(54) CYLINDRICAL LOCK WITH SIMPLER POSITIONING ASSEMBLY

(76) Inventor: Mu-Lin Shen, No. 32, Lane 76, Fu-An Road, Sec. 5, Tainan (TW)

( * ) Notice: Subject to any disclaimer, the term of this patent is extended or adjusted under 35 U.S.C. 154(b) by 0 days.

(21) Appl. No.: 09/375,650

(22) Filed: Aug. 17, 1999

(51) Int. Cl.[7] ..... E05B 13/10

(52) U.S. Cl. ..... 70/224; 70/451; 70/452; 292/336.3; 292/357

(58) Field of Search ..... 70/224, 223, 370, 70/451, 452, 449, 381; 292/356, 357, 337, 336.3, DIG. 53, DIG. 64

(56) References Cited

U.S. PATENT DOCUMENTS

| | | | | |
|---|---|---|---|---|
| 2,795,948 | * | 6/1957 | Rayburn | 292/357 X |
| 3,550,411 | * | 12/1970 | Neary | 70/370 |
| 4,869,083 | * | 9/1989 | DeMarseilles et al. | 70/224 |
| 4,921,289 | * | 5/1990 | Shen | 292/336.3 |
| 5,590,555 | * | 1/1997 | Kester et al. | 292/357 X |
| 5,605,064 | * | 2/1997 | Katayama et al. | 70/224 |
| 5,761,936 | * | 6/1998 | Katayama et al. | 70/224 |
| 5,845,522 | * | 12/1998 | Shen | 70/224 |
| 6,151,934 | * | 11/2000 | Chong et al. | 70/224 X |

* cited by examiner

*Primary Examiner*—Suzanne Dino Barrett

(74) *Attorney, Agent, or Firm*—Alan Kamrath; Rider, Bennett, Egan & Arundel, LLP

(57) ABSTRACT

A cylindrical lock includes a transmission assembly and a positioning assembly. The transmission assembly includes a retractor, an inside spindle, an outside spindle, a latch bolt, a lock core transmission device, an inside handle, and an outside handle. The positioning assembly includes an inside hub, an outside hub, an inside escutcheon, and an outside escutcheon. The inside hub includes a flange formed on an outer periphery thereof. Two diametrically opposed tabs project from a first side of the inside hub. A tubular member projects from a second side of the inside hub and includes two diametrically opposed recesses in an outer periphery thereof. Two diametrically disposed through-holes are defined in the flange and aligning with the recesses, respectively. The outside hub includes a tubular section having an outer threading with two diametrically opposed recessed sections. The tubular section includes an annular flange formed on an inner periphery thereof. An annular wall extends longitudinally from the tubular section and has an inner diameter greater than that of the tubular section. The annular wall includes two notches aligned with the recessed sections of the outside hub, respectively. A bottom wall defining each notch has a screw hole extended therethrough and aligned with an associated through-hole in the inside hub. The tabs of the inside hub are received in the notches of the outside hub. Two bolts are extended through the through-holes in the inside hub and the screw holes in the outside hub.

5 Claims, 5 Drawing Sheets

CYLINDRICAL LOCK WITH SIMPLER POSITIONING ASSEMBLY

BACKGROUND OF THE INVENTION

1. Field of the Invention

The present invention relates to a cylindrical lock with simpler positioning assembly that has reduced number of components to allow easy assembly procedure and short assembly time in addition to improved structural strength.

2. Description of the Related Art

Cylindrical locks of the type having levers are commonly used in public areas for providing operational convenience to handicapped people. Yet, the internal components of the lever type cylindrical locks are apt to be damaged by the relatively large torque resulting from turning of the lever. U.S. Pat. No. 3,126,217 to Russell et al issued on Mar 24. 1964 discloses a low-friction frame for locking devices. Nevertheless, a housing 10 is required to enclose the left and right frame sections 13 and 12 after assembly. Namely, the component number is still too large and the assembly procedure is time-consuming. U.S. Pat. No. 5,845,522 to Shen issued on Dec. 8, 1998 discloses a fastening arrangement for a cylindrical lock for firmly connecting stationary components of the lock together and for securely anchoring the firmly connected stationary components to the door so as to ensure proper operation of the door. Nevertheless, it is found that there are too many fastening components, including chassis, outer casing for chassis, inside escutcheon, outside escutcheon, inside hub and outside hub. The cost is high and the assembly procedure is time-consuming. In addition, the outside escutcheon with studs should be further improved in the structural strength to prevent forcible destruction.

The present invention is intended to provide a cylindrical lock with simpler yet stronger positioning assembly device that mitigates and/or obviates the above problems.

SUMMARY OF THE INVENTION

A cylindrical lock in accordance with the present invention comprises:

a transmission assembly including a retractor, an inside spindle, an outside spindle, a latch bolt, a lock core transmission device, an inside handle, and an outside handle; and a positioning assembly including an inside hub, an outside hub, an inside escutcheon, and an outside escutcheon;

the improvements comprising:

the inside hub including a flange formed on an outer periphery thereof, the inside hub further including a first side and a second side, two diametrically opposed tabs projecting from the first side of the inside hub, a tubular member projecting from the second side of the inside hub and including two diametrically opposed recesses in an outer periphery thereof, two diametrically disposed through-holes being defined in the flange and aligning with the recesses, respectively;

the outside hub including a tubular section having an outer threading with two diametrically opposed recessed sections, the tubular section including an annular flange formed on an inner periphery thereof, an annular wall extending longitudinally from the tubular section and having an inner diameter greater than that of the tubular section, the annular wall including two notches aligned with the recessed sections of the outside hub, respectively, a bottom wall defining each said notch having a screw hole extended therethrough and aligned with an associated said through-hole in the inside hub, the annular wall of the outside hub further including an inwardly, radially extending arcuate supporting ledge projected from an inner periphery thereof, an arcuate stepped section being formed on the inner periphery of the annular wall and located between the supporting ledge and the annular flange, a longitudinal passage being extended through the annular flange and the stepped section;

the tabs of the inside hub being received in the notches of the outside hub, and further comprising two bolts extended through the through-holes in the inside hub and the screw holes in the outside hub;

the inside escutcheon including two diametrically disposed first lugs fittingly received in the recesses of the inside hub, respectively;

the outside escutcheon including two diametrically disposed second lugs fittingly received in the recessed sections of the outside hub, respectively;

the lock core transmission device including a sleeve connected to the lock core to rotate therewith, the sleeve having a wing plate for operative connection with the latch bolt, the lock core transmission device further including a locking piece with a neck portion, the neck portion being engaged with the outside spindle to rotate therewith, wherein the locking piece is rotatably received in a compartment defined between the arcuate supporting ledge and the arcuate stepped section when the cylindrical lock is in an unlatched status, and wherein the locking piece being longitudinally moved into the longitudinal passage when the push button is pushed, thereby rendering a latched status for the cylindrical lock;

further comprising a ring-like reinforcing plate mounted to an outer side of the outside escutcheon, the reinforcing plate including two diametrically disposed outwardly extending ears each having a positioning post for engaging with the inside escutcheon.

A tightening ring is mounted to an outer side of the reinforcing plate, the tightening ring including an inner threading for engaging with the outer threading of the outside hub. At least one of said recessed sections of the outside hub includes a scale for providing a reference to threaded engagement between the tightening ring and the outer threading of the outside hub.

The outside spindle further includes a guide member that is extended through the longitudinal passage and then rotated through an angle such that the guide member no longer aligns with the longitudinal passage, thereby preventing disengagement of the outside spindle.

The outside hub further includes two aligned second notches, the transmission assembly further includes a positioning plate securely engaged with the second notches, and a spring is provided for biasing the retractor toward the latch bolt.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
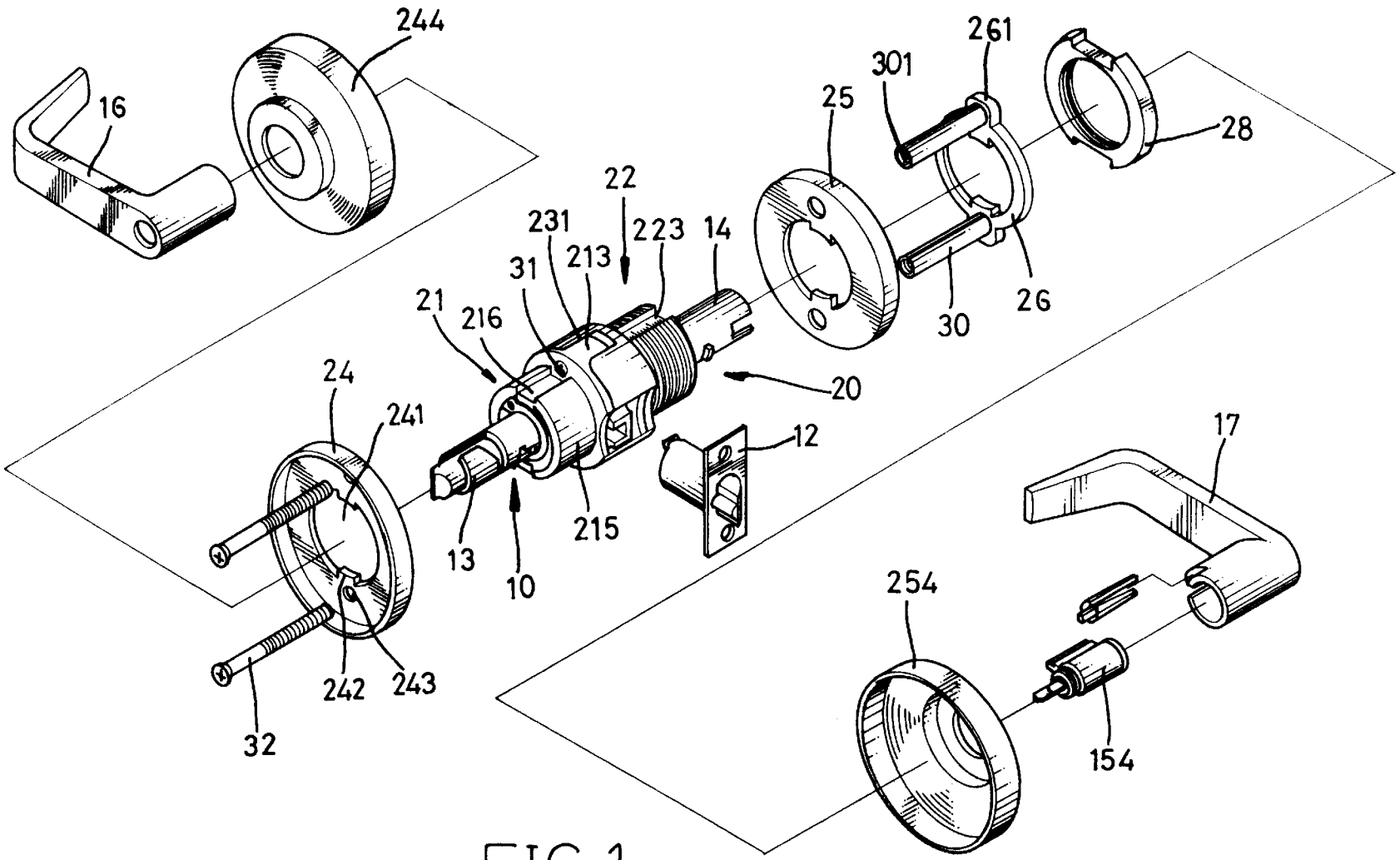
FIG. 1 is an exploded perspective view of a cylindrical lock in accordance with the present invention.
Figure 2:
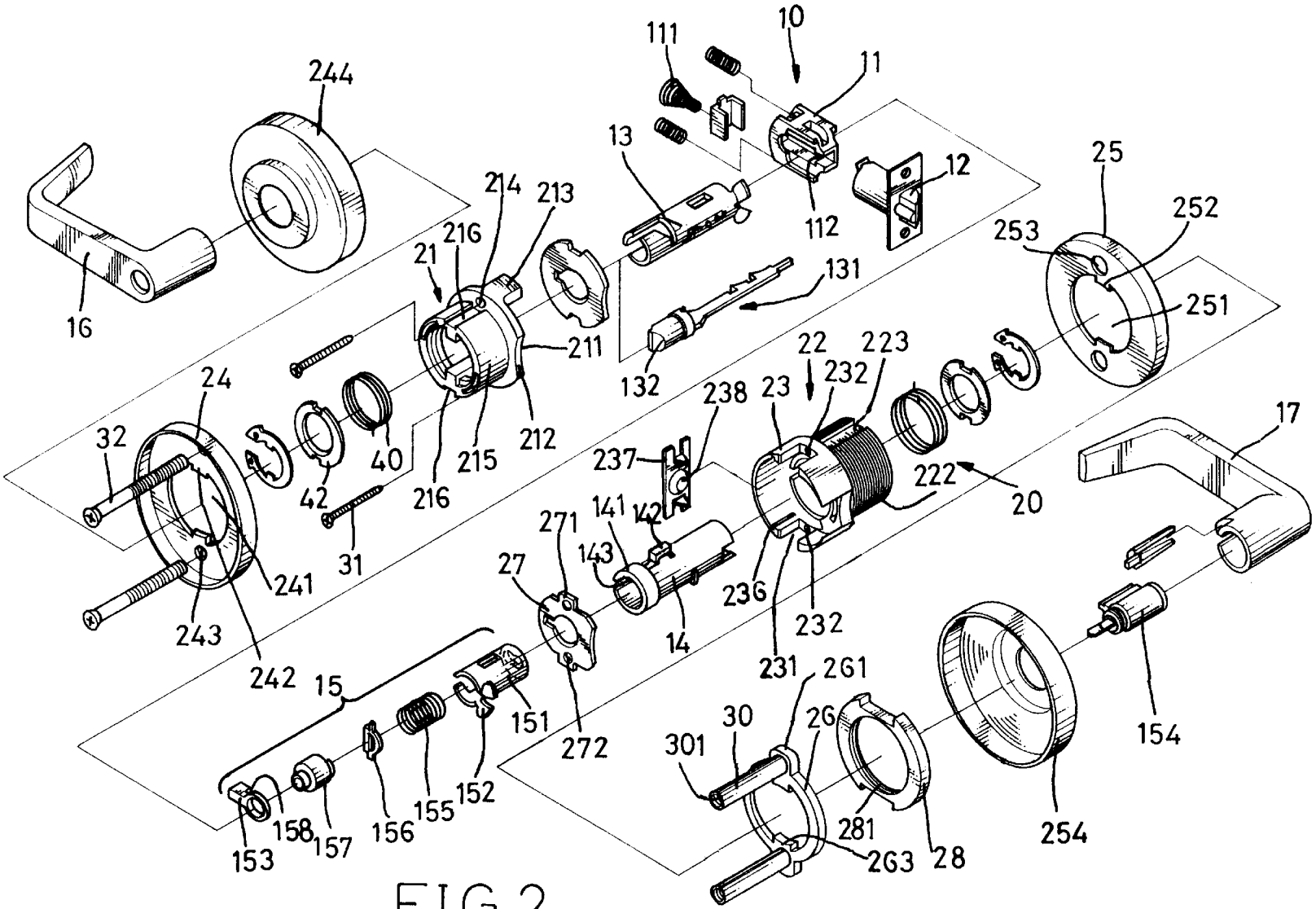
FIG. 2 is a further exploded perspective view of the cylindrical lock in accordance with the present invention.

Referring to FIGS. 1 through 5 and initially to FIGS. 1 and 2, a cylindrical lock in accordance with the present invention generally includes a transmission assembly 10 and a positioning assembly 20. The transmission assembly 10 includes a retractor 11, an inside spindle 13, an outside spindle 14, and a latch bolt 12. The retractor 11 is mounted in an outside hub 22 of the positioning assembly 20. The outside hub 22 includes an annular wall 23 with aligned positioning grooves 236 for receiving upper and lower ends of a positioning plate 237. A spring 111 is mounted to a protrusion 238 formed on a side of the positioning plate 237 for biasing the retractor 11 toward the latch bolt 12. The retractor 11 includes a rectangular groove 112 in a front end thereof for securely engaging with the latch bolt 12 to move therewith. The inside spindle 13 and the outside spindle 14 are mounted to two sides of the retractor 11, respectively. The inside spindle 13 includes a locking bar 131 mounted therein. A push button 132 is formed on an outer end of the locking bar 131. The outside spindle 14 includes a lock core transmission device 15 and a lock core 154 mounted therein. An inside handle 16 is secured to the inside spindle 13 to rotate therewith and an outside handle 17 is secured to the outside spindle 14 to rotate therewith. Rotation of either handle 16, 17 causes retraction movements of the retractor 11 and the latch bolt 12.

The present invention is characterized in that provision of the inside hub 21, the outside hub 22, inside escutcheon 24, and outside escutcheon 25 that constitute the positioning assembly 20. The component number is reduced, yet the structural strength is improved. As illustrated in FIG. 2, the inside hub 21 includes a flange 211 with a cut 212. Two diametrically disposed tabs 213 project from a side of the inside hub 21. A tubular member 215 projects from the other side of the inside hub 21 and includes two diametrically opposed recesses 216 in an outer periphery thereof. Two diametrically disposed through-holes 214 are defined in the flange 211 and align with the recesses 216, respectively.

Figure 3:
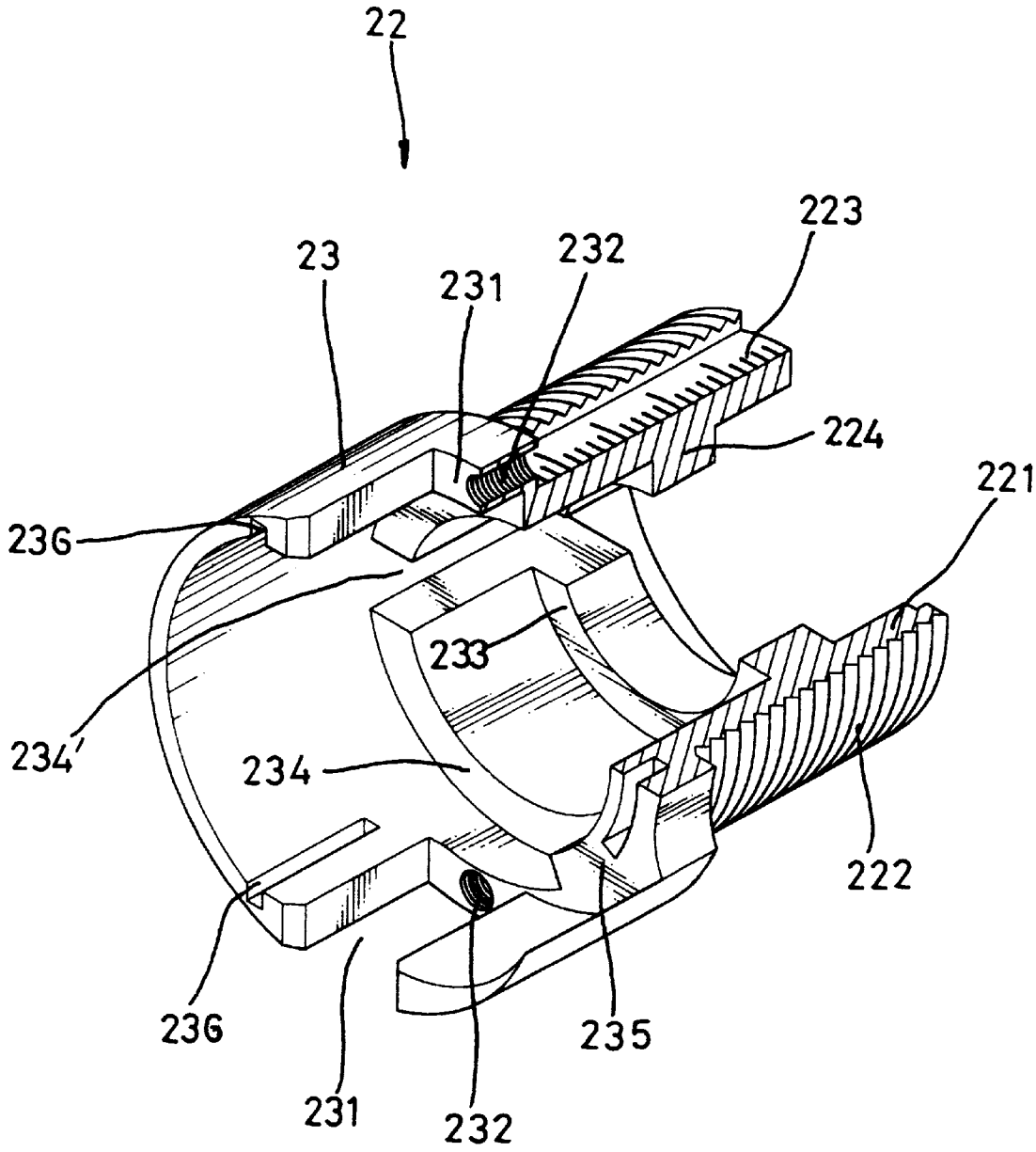
FIG. 3 is a perspective view, partly cutaway, of an outside hub of the cylindrical lock in accordance with the present invention.

Referring to FIG. 3, the outside hub 22 includes a tubular section 221 having an outer threading 222 with two diametrically opposed recessed sections 223 each having a scale thereon. An annular flange 224 is formed on an inner periphery of the tubular section 221. The above-mentioned annular wall 23 extends longitudinally from an end of the tubular section 221 and has an enlarged inner diameter. The annular wall 23 includes two notches 231 aligned with the recessed sections 223. A bottom wall defining each notch 231 has a screw hole 232 extended therethrough.

Figure 5:
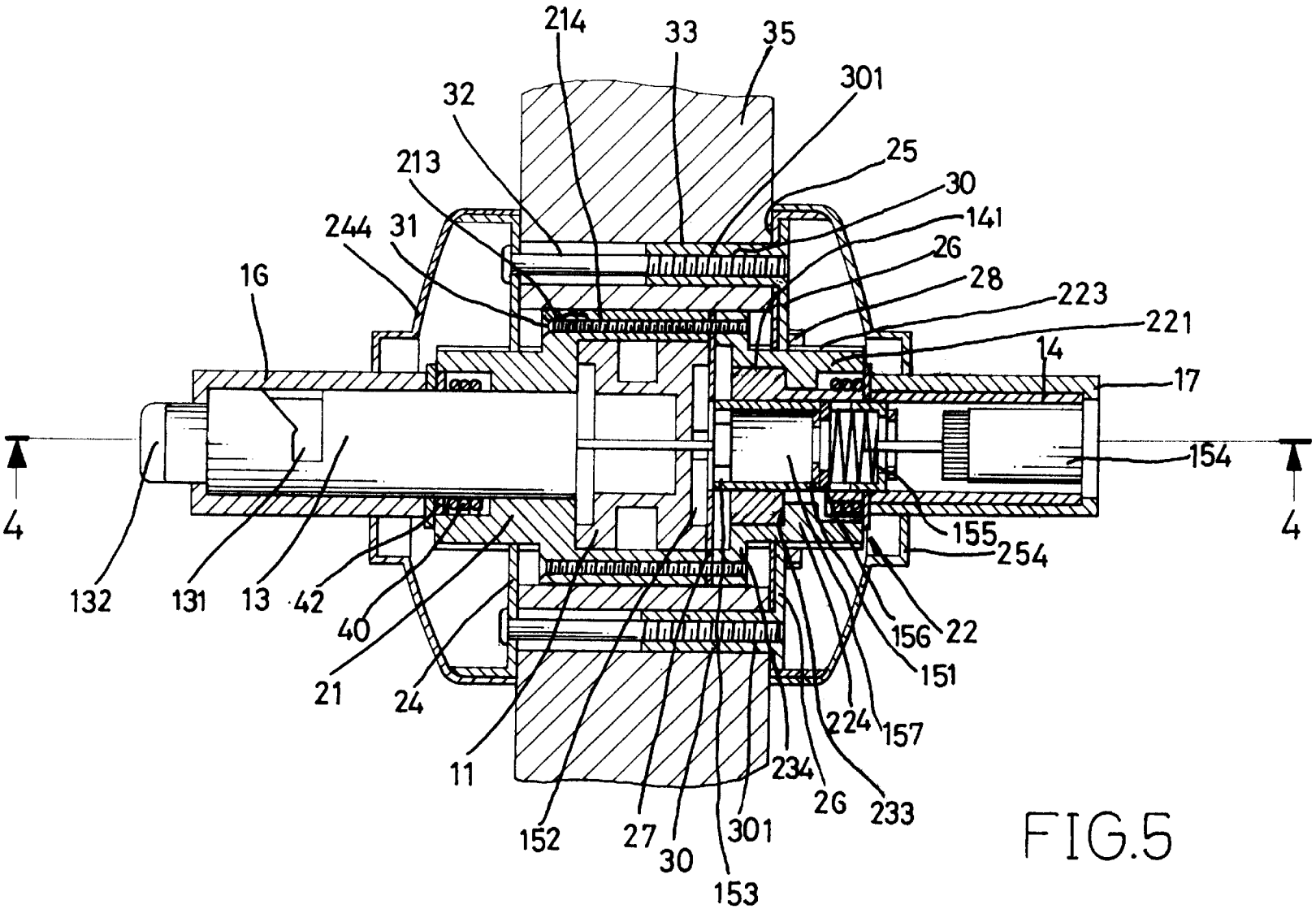
FIG. 5 is a sectional view taken along line 5–5 in FIG. 4.

Still referring to FIG. 3, the annular wall 23 includes an inwardly, radially extending supporting ledge 235 projects from an inner periphery thereof The supporting ledge 235 extends for an arc approximately the same as a half of the circumference of the inner periphery. An arcuate stepped section 234 is formed on the inner periphery of the annular wall 23 and located between the supporting ledge 235 and the annular flange 224 (FIGS. 3 and 5).

Referring to FIG. 2, an abutting plate 27 includes a protrusion 271 formed on each of an upper end and a lower end thereof and having a hole 272 therein. The protrusions 271 are inserted into the notches 231 with the holes 272 aligned with the screw holes 232 when the abutting plate 27 bears against the supporting ledge 235 (see FIG. 5). The retractor 11 is mounted in the outside hub 22, assembly between the inside hub 21 and the outside hub 22 is accomplished by inserting the tabs 213 of the inside hub 21 into the notches 231 of the outside hub 22 and aligning the through-holes 214 of the inside hub 21 with the screw holes 232 of the outside hub 22.

Still referring to FIG. 2, the inside escutcheon 24 is mounted inside an inside escutcheon facing 244 and is substantially disclike with a central opening 241 through which and end of the inside handle 16 extends. An inner periphery defining the opening 241 includes two diametrically disposed lugs 242 (FIFS. 1 and 2) that are inserted into the recesses 216 of the inside hub 21. The inside escutcheon 24 includes two screw holes 243 formed adjacent to the lugs 242, respectively. Similarly, the outside escutcheon 25 is mounted inside an outside escutcheon facing 254 and is substantially disc-like with a central opening 251 through which and end of the outside handle 17 extends. An inner periphery defining the opening 251 includes two diametrically disposed lugs 252 that are inserted into the recessed sections 223 of the outside hub 22. The inside escutcheon 25 includes two screw holes 253 formed adjacent to the lugs 252, respectively, best shown in FIG. 2.

Still referring to FIGS. 1 and 2, a ring-like reinforcing plate 26 is mounted to a side of the outside escutcheon 25 and includes two diametrically disposed outwardly extending ears 261. Each ear 261 has a positioning post 30 projects therefrom and extends along an axial direction. In an embodiment of the invention, the ear 261 has a hole (not shown) and the positioning post 30 is secured in the hole of the ear 261 by, e.g., riveting. Each positioning post 30 includes a screw hole 31 and extends through an associated hole 253 in the outside escutcheon 25.

Referring to FIG. 2, the lock core transmission device 15 includes a sleeve 151 with a wing plate 152. A spring 155, a slide 156, a small cylinder 157, and a locking piece 153 having are mounted in the sleeve 151. The locking piece 153 includes a necked portion 158

Figure 4:
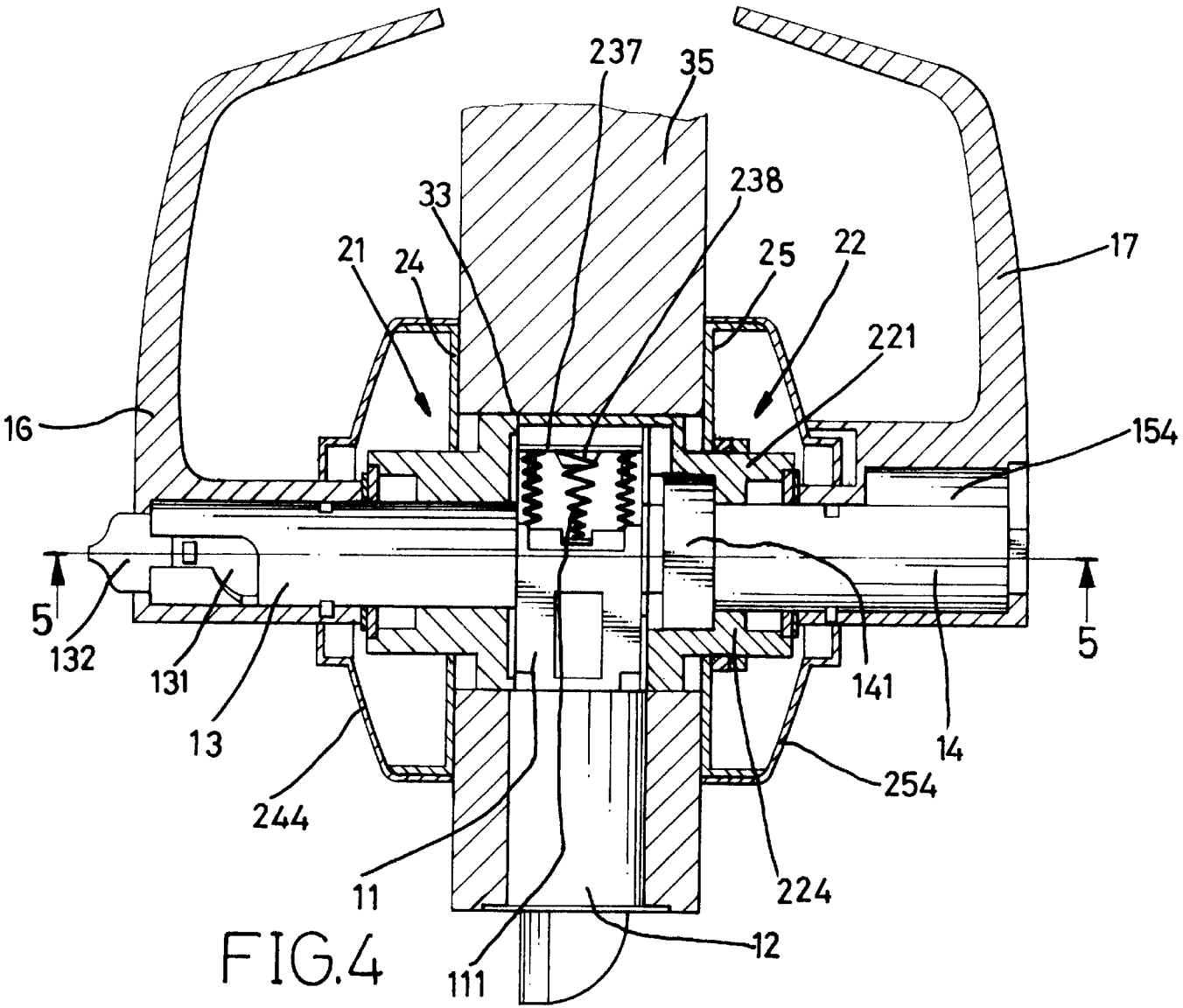
FIG. 4 is a sectioned top view, taken along line 4–4 in FIG. 5 of the cylindrical lock in accordance with the present invention.

In assembly, referring to FIGS. 2, 4, and 5, the transmission device 15 is mounted in the outside spindle 14. The outside spindle 14, abutting plate 27, positioning plate 237, spring 111, and retractor 11 are mounted into the outside hub 22. It is appreciated that an enlarged end 141 of the outside spindle 14 is received in a compartment between the stepped section 234 and the annular flange 224 and bears against a face 223 of the annular flange 224. In addition, the wing plate 152 of the sleeve 151 extend beyond the abutting plate 27 and engages with the retractor 11 for moving the latch bolt 12 between an extended position and a retracted position. The necked portion 158 of the locking piece 153 is received in a notch 143 (FIG. 2) of the outside spindle 14. It is appreciated that the outside spindle 14 further includes a guide member 142 (FIG. 2) that is extended through a longitudinal passage 234' (FIG. 3) extended through the stepped section 234 and the annular flange 224 during assembly The outside spindle 14 is then rotated through an angle such that the guide member 142 no longer aligns with the longitudinal passage 234', thereby preventing disengagement of the outside spindle 14. The locking rod 131 is then mounted in the inside spindle 13. The inside spindle 13, a torsion spring 40, and a retainer ring 42 are mounted into the inside hub 21. Next, the inside hud 21 and the outside hub 22 are assembled together, wherein the tabs 213 of the inside hub 21 are inserted into the notches 231 of the outside hub 22, thereby providing a secure engagement. The through-holes 214 of the inside hub 21 align with the screw holes 232 of the outside hub 22. Then, positioning screws or bolts 31 are extended through the through-holes 214 and holes 272 into the screw holes 232 in the outside hub 22.

Referring to FIGS. 2 and 5, after assembly of the inside hub 21 and the outside hub 22, the positioning posts 30 on the reinforcing plate 26 are extended through the hole 33 from outside, and positioning bolts 32 are extended through the holes 243 in the inside escutcheon 24 into the screw holes 301 in the positioning posts 30. An inner threading 281 of a tightening ring 28 is threadedly engaged with outer threading 222 of the outside hub 22 and adjusted in response to the thickness of the door panel 35. During rotation of the tightening ring 28, the scale in each recessed section 223 of the outside hub 22 provides the best reference. After appropriate adjustment, the lock main body is inserted into a hole 33 in the door panel 35, the tightening ring 28 is threadedly engaged on the outer threading 222 of the outside hub 22 at a proper location in which a side of the tightening ring 28 bears against an outer side of the reinforcing plate 26. Thereafter, the outside handle 17, lock core 154, and the outside escutcheon facing 254 are mounted to an outer side of the door panel 35. The inside handle 16 and the inside escutcheon facing 244 are mounted to an inner side of the door panel 35, thereby forming a lever type cylindrical lock.

The spindle 14 is rotatable when the push button 132 of the locking bar 131 is not pressed, as the locking piece 153 is rotatably located in a compartment between the stepped portion 234 and the supporting ledge 235. When the push button 132 is pressed, the locking piece 153 is moved longitudinally inward into the longitudinal passage 234' via transmission of the inside spindle 13. Thus, rotation of the locking piece 153 is prevented by the walls defining the longitudinal passage 234'. Namely, the sleeve 151 is not rotatable and thus incapable of retracting the latch bolt 12.

According to the above description, it is appreciated that the positioning assembly of the invention merely includes two primary components (the inside hub 21 and outside hub 22) that cooperate with the inside escutcheon 24 and outside escutcheon 25. More specifically, the inside hub 21 and outside hub 22 are configured to replace several components in prior art cylindrical locks (e.g., the inside hub, outside hub, chassis, outer casing for chassis in U.S. Pat. No. 5,845,522 to Shen). Thus, the present invention provides a positioning assembly with simpler, reliable structure to lower the cost and to allow easy assembly procedure. In addition, the tabs 213 of the inside hub 21 are securely inserted into the notches 231 of the outside hub 22 and bolts 31 are then extended through the inside and outside hubs 21 and 22, thereby providing improved secure engagement. Thus, potential loosening as a result of assembly of numerous components is avoided. Furthermore, the reinforcing plate 26 with positioning posts 30 improves the structural strength in an outer portion of the lock. Besides, the lugs 242 of the inside escutcheon 24 are inserted into the recesses 216 of the inside hub 21 and the lugs 252 of the outside escutcheon 25 are inserted into the recessed sections 223 of the outside hub 22. This reliably provides improved tightening force to avoid loosening in the inside and outside escutcheons 24 and 25 as a result of rotation in either handle 16, 17. Furthermore, the scale in each recessed section 223 of the outside hub 22 provides a convenient reference for the installer. Namely, the installer may decide the central position of the lock upon visual estimation, thereby rendering on-site assembly of the lock more convenient.

Although the invention has been explained in relation to its preferred embodiment, it is to be understood that many other possible modifications and variations can be made without departing from the spirit and scope of the invention as hereinafter claimed.

What is claimed is:

1. A cylindrical lock comprising:

a transmission assembly including a retractor, an inside spindle, an outside spindle, a latch bolt, a lock core transmission device, an inside handle, and an outside handle; and a positioning assembly including an inside hub, an outside hub, an inside escutcheon, and an outside escutcheon;

the improvements comprising:

the inside hub including a flange formed on an outer periphery thereof, the inside hub further including a first side and a second side, two diametrically opposed tabs projecting from the first side of the inside hub, a tubular member projecting from the second side of the inside hub and including two diametrically opposed recesses in an outer periphery thereof, two diametrically disposed through-holes being defined in the flange and aligning with the recesses, respectively;

the outside hub including a tubular section having an outer threading with two diametrically opposed recessed sections, the tubular section including an annular flange formed on an inner periphery thereof, an annular wall extending longitudinally from the tubular section and having an inner diameter greater than that of the tubular section, the annular wall including two notches aligned with the recessed sections of the outside hub, respectively, a bottom wall defining each said notch having a screw hole extended therethrough and aligned with an associated said through-hole in the inside hub, the annular wall of the outside hub further including an inwardly, radially extending arcuate supporting ledge projected from an inner periphery thereof, an arcuate stepped section being formed on the inner periphery of the annular wall and located between the supporting ledge and the annular flange, a longitudinal passage being extended through the annular flange and the stepped section;

the tabs of the inside hub being received in the notches of the outside hub, and further comprising two bolts extended through the through-holes in the inside hub and the screw holes in the outside hub;

the inside escutcheon including two diametrically disposed first lugs fittingly received in the recesses of the inside hub, respectively;

the outside escutcheon including two diametrically disposed second lugs fittingly received in the recessed sections of the outside hub, respectively;

the lock core transmission device including a sleeve connected to the lock core to rotate therewith, the sleeve having a wing plate for operative connection with the latch bolt, the lock core transmission device further including a locking piece with a neck portion, the neck portion being engaged with the outside spindle to rotate therewith, wherein the locking piece is rotatably received in a compartment defined between the arcuate supporting ledge and the arcuate stepped section when the cylindrical lock is in an unlatched status, and wherein the locking piece being longitudinally moved into the longitudinal passage when the push button is pushed, thereby rendering a latched status for the cylindrical lock;

further comprising a ring-like reinforcing plate mounted to an outer side of the outside escutcheon, the reinforcing plate including two diametrically disposed outwardly extending ears each having a positioning post for engaging with the inside escutcheon.

2. The cylindrical lock assembly as claimed in claim 1, further comprising a tightening ring mounted to an outer side of the reinforcing plate, the tightening ring including an inner threading for engaging with the outer threading of the outside hub.

3. The cylindrical lock assembly as claimed in claim 2, wherein at least one of said recessed sections of the outside hub includes a scale for providing a reference to threaded engagement between the tightening ring and the outer threading of the outside hub.

4. The cylindrical lock assembly as claimed in claim 1, wherein the outside spindle further includes a guide member that is extended through the longitudinal passage and then rotated through an angle such that the guide member no longer aligns with the longitudinal passage, thereby preventing disengagement of the outside spindle.

5. The cylindrical lock assembly as claimed in claim 1, wherein the outside hub further includes two aligned second notches, and wherein the transmission assembly further includes a positioning plate securely engaged with the second notches, and a spring is provided for biasing the retractor toward the latch bolt.

* * * * *